US006375050B1

(12) United States Patent
Gruson

(10) Patent No.: US 6,375,050 B1
(45) Date of Patent: Apr. 23, 2002

(54) FILLING SPOUT WHOSE FLOW RATE CAN BE ADJUSTED BY A SINGLE ACTUATOR DEVICE

(75) Inventor: Bertrand Gruson, Breville/Mer (FR)

(73) Assignee: Serac Group, La Ferte Bernard (FR)

( * ) Notice: Subject to any disclaimer, the term of this patent is extended or adjusted under 35 U.S.C. 154(b) by 0 days.

(21) Appl. No.: 09/721,943

(22) Filed: Nov. 27, 2000

(30) Foreign Application Priority Data

Nov. 29, 1999 (FR) ..... 99 14993

(51) Int. Cl.[7] ..... B67D 3/00
(52) U.S. Cl. ..... 222/504; 281/129.19; 137/614.11
(58) Field of Search ..... 222/504, 559; 141/301, 302, DIG. 1; 251/65, 77, 129.11, 129.19; 137/614.11

(56) References Cited

U.S. PATENT DOCUMENTS 4,757,847 A 7/1988 Jörss et al.
4,940,207 A * 7/1990 Katsuyama ..... 251/65
5,450,877 A * 9/1995 Graffin ..... 137/630.14
5,469,880 A 11/1995 Zimmerly
5,676,344 A * 10/1997 Graffin ..... 251/65
5,816,456 A 10/1998 Graffin

* cited by examiner

*Primary Examiner*—John Kwon
*Assistant Examiner*—Melvin A. Cartagena
(74) *Attorney, Agent, or Firm*—Birch, Stewart, Kolasch & Birch, LLP

(57) ABSTRACT

A filling spout having an adjustable flow rate and comprising a valve body receiving a valve member extending facing a valve seat, and a flow-rate adjustment member disposed upstream from the valve member and extending in register with a constriction in the valve body, the valve member and the flow-rate adjustment member being connected to a single actuator device via means allowing limited axial movement by enabling the adjustment member and the valve member to move axially relative to each other to a limited extent.

13 Claims, 5 Drawing Sheets

FILLING SPOUT WHOSE FLOW RATE CAN BE ADJUSTED BY A SINGLE ACTUATOR DEVICE

The present invention relates to a filling spout whose flow rate can be adjusted by a single actuator device.

BACKGROUND OF THE INVENTION

Document FR-A-2 736 339 discloses a filling spout comprising a valve body receiving firstly a valve member which is opened and closed to determine whether or not the substance flows, and secondly a flow-rate adjustment member making it possible to vary the flow-rate inside the filling spout independently of valve member opening, in order to obtain a uniform flow of substance regardless of the degree of opening of the valve member.

In order to enable the valve member and the flow-rate adjustment member to move independently from each other, it is necessary to implement two separate actuator devices controlled in synchronized manner. That requirement not only penalizes filling spout compactness but also makes the control electronics very complex, in particular when the filling machine is provided with a large number of filling spouts, as is generally the case in current filling installations.

OBJECTS AND SUMMARY OF THE INVENTION

A first object of the invention is to provide a filling spout having an adjustable flow rate and that can operate with a single actuator device.

To this end, the invention provides a filling spout having an adjustable flow rate and comprising a valve body receiving a valve member extending facing a valve seat, and a flow-rate adjustment member disposed upstream from the valve member and extending in register with a constriction in the valve body, the valve member and the flow-rate adjustment member being connected to a single actuator device via means allowing limited axial movement by enabling the adjustment member and the valve member to move axially relative to each other to a limited extent.

Thus, by using a single actuator device, it is possible for the valve member and the flow-rate adjustment member to move differently from each other.

In addition, it is known that, due to the impact exerted by the jet of substance on the bottom of a container at the beginning of filling, there is a risk that froth might form, thereby preventing the filling cycle from taking place properly. Similarly, at the end of filling, on closing the valve member, there is a risk that the jet might be deformed, thereby causing splashing on the outside of the container. In order to avoid those drawbacks, the above-mentioned document makes provision to reduce the flow rate through the flow-rate adjustment member when the valve member opens and closes. Unfortunately, by closing the flow-rate adjustment member almost totally, there is a risk that the bottom portion of the filling spout might not be fed sufficiently between two cycles, in particular when the substance is thick.

In an advantageous version of the invention, the means allowing limited axial movement are suitable for enabling the flow-rate adjustment member to be put in position of maximum flow rate or of minimum flow rate, while the valve member is in a closed position. Starting from a position in which the valve member is closed and the adjustment member is in a position of maximum flow rate, it is possible to perform the following steps:

reducing the flow rate to a position of substantially minimum flow rate;

gradually opening the valve member while increasing the flow rate delivered by the flow-rate adjustment member in corresponding manner;

gradually closing the valve member by reducing the flow rate delivered by the flow-rate adjustment member in corresponding manner until the valve member is fully closed; and putting the flow-rate adjustment member back into its maximum flow rate position.

Thus, on valve member opening, the force of the jet of substance is low due to the flow-rate adjustment member being adjusted to deliver substantially its minimum flow rate so that the impact against the bottom of the container is itself low, and so that the risk of froth forming is minimized. Similarly, on valve member closure, the reduction in the flow rate provided by the flow-rate adjustment member minimizes jet deformation and makes it possible to avoid splashing the outside of the container, and going through a position of maximum flow rate between valve member closure and the following cycle makes it possible to obtain satisfactory feeding of the filling spout downstream from the flow-rate adjustment member.

BRIEF DESCRIPTION OF THE DRAWINGS

Other characteristics and advantages of the invention will appear on reading the following description of three particular non-limiting embodiments of the invention given with reference to the accompanying figures, in which.

MORE DETAILED DESCRIPTION

Figure 1:
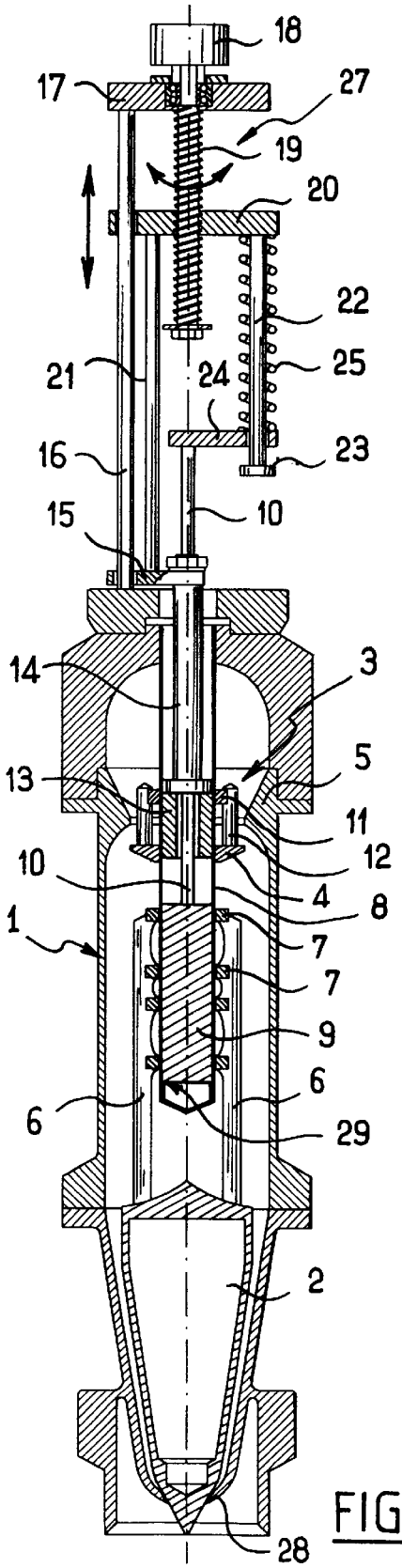
FIG. 1 is a diagrammatic longitudinal section view of a filling spout of the invention in its position at the beginning and at the end of the filling cycle.

As shown in FIG. 1, the preferred embodiment of the filling spout of the invention comprises a valve body 1 which receives a valve member 2 and a flow-rate adjustment device given overall reference 3 and including a flow-rate adjustment member 4 in the form of a disk mounted to slide facing a portion of the valve body 1 provided with a constriction 5 of varying section.

The valve member 2 is moved inside the valve body 1 by a drive device made up of magnetic stainless steel plates 6 and whose bottom end is fixed to the valve member 2, while its top end is connected to collars 7 made of materials having high magnetic permeability and mounted to slide on a sleeve 8 made of non-magnetic material (shown in bold lines in the figure), which sleeve receives a magnetic field generator 9 so that it is mounted to slide facing the collars 7 and so that it is fixed to the bottom end of a control rod 10. The plates 6 extend vertically and radially inside the valve body 1, thereby not only mechanically coupling the collars 7 to the valve member 2, but also providing magnetic bridging between the collars 7, and said plates serve to perform an anti-vortex function when the filling spout is mounted on a carrousel.

Similarly, the flow-rate adjustment member 4 is made of a material having high magnetic permeability, and it is mounted to slide about the non-magnetic sleeve 8. The flow-rate adjustment member 4 is connected to a collar 11 having high magnetic permeability via small columns 12 extending in the longitudinal direction of the valve body 1. A magnetic field generator 13 extends inside the non-magnetic sleeve 8 facing the collar 11 and the flow-rate adjustment member 4, and is connected to a control tube 14.

The top portion of the control tube 14 is equipped with a control plate 15 mounted to slide on a guide rod 16 whose bottom end is fixed to the valve body 1 which is itself suitable for being fixed to the frame of a machine, and whose top end is fixed to a support plate 17 that is also suitable for being fixed to the frame of a machine. The plate 17 supports a stepper motor 18 fixed to a screw 19 associated with an actuating member 20 in the form of a plate extending perpendicularly to the screw 19. The actuating member 20 is mounted on the screw 19 to transform the rotation of the screw 19 into a vertical displacement of the actuating member 20. The actuating member 20 is also mounted to slide on the guide rod 16 which thus not only performs a guide function but also prevents the actuating member 20 from rotating while the screw 19 is rotating. The stepper motor 18, the screw 19, and the actuating member 20 constitute an actuator device that is given overall reference 27.

The actuating member 20 is connected to the control plate 15 of the flow-rate adjustment member 4 via a link rod 21 that is rigidly fixed at its top end to the actuating member 20 and at its bottom end to the control plate 15.

The actuating member 20 also carries a guide rod 22 extending vertically and whose top end is fixed to the actuating member 20 while its bottom end is provided with an end-of-stroke abutment 23. In addition, the top end of the control rod 10 of the valve member 2 is equipped with a valve member control element 24 in the form of a plate extending perpendicularly to the guide rod 22 and mounted to slide thereon. A spring 25 is mounted around the guide rod 22 and abuts via its top end against the actuating member 20 and via its bottom end against the valve member control element 24. The spring 25 therefore forms an elastically-deformable link member between the actuating member 20 and the control element 24 of the valve member control device comprising the control rod 10 and the control element 24.

In the position shown in FIG. 1, the actuating member 20 is in the low position so that the control plate 15 of the flow-rate adjustment member 4 is itself in the low position. In the preferred embodiment shown, the length of the control tube 14 is organized so that the flow-rate adjustment member 4 is then positioned below the constriction 5 in the valve body 1 so as to make a maximum flow rate possible through the constriction 5. In parallel, the relative length of the valve member control rod 10 is such that, when the actuating member 20 is in this position, the valve member 2 is in abutment against its seat 28 while the control plate 24 is offset upwards relative to the end-of-stroke abutment 23. The spring 25 is thus compressed and the force that it exerts on the control plate 24 causes the field generator 9 to be pressed against a shoulder 29 of the non-magnetic tube 8. The valve member 2 is thus firmly held in the closed position while the flow-rate adjustment member 4 is in a position of maximum flow rate, thereby enabling the bottom portion of the valve body 1 to be fed without any risk of air bubbles being trapped, even with a substance of high viscosity.

It is in this position that a filling cycle is started. Starting from this position, the actuating stepper motor 18 is controlled so as to rotate in a direction causing the actuating member 20 to be raised. The actuating member 20 moving upwards causes the flow-rate adjustment member 4 to move immediately upwards, and simultaneously causes the end-of-stroke abutment 23 to move upwards. However, so long as the end-of-stroke abutment 23 is not in contact with the control plate 24, the valve member 2 remains closed. As from the instant at which the end-of-stroke abutment 23 is in contact with the control plate 24, any subsequent upward movement of the actuating member 20 causes the valve member 2 to open by entraining the control rod 10. The stroke of the end-of-stroke abutment 23 is determined so that, when said abutment comes into contact with the control plate 24, the flow-rate adjustment member 4 is situated facing the minimum cross-section of the constriction 5.

Figure 2:
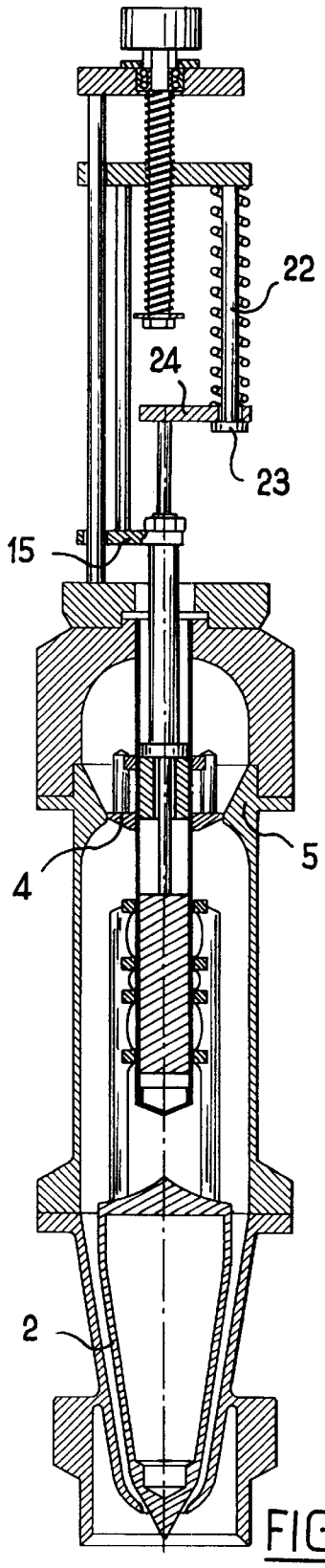
FIG. 2 is a view analogous to the FIG. 1 view, in a position just after the beginning of a filling cycle.

In the position just after the beginning of opening of the valve member 2, which position is shown in FIG. 2, the position of the flow-rate adjustment member 4 still corresponds to a substantially minimum flow rate. The dynamic pressure of the jet of substance flowing out from the filling spout is thus low, thereby avoiding froth from forming at the beginning of filling. After a short time, making it possible to insert into the container a quantity of substance sufficient to damp the impact of the jet against the top surface of the substance contained in the container, the stepper motor 18 is once again controlled to cause the actuating member 20 to continue to move upwards.

Figure 3:
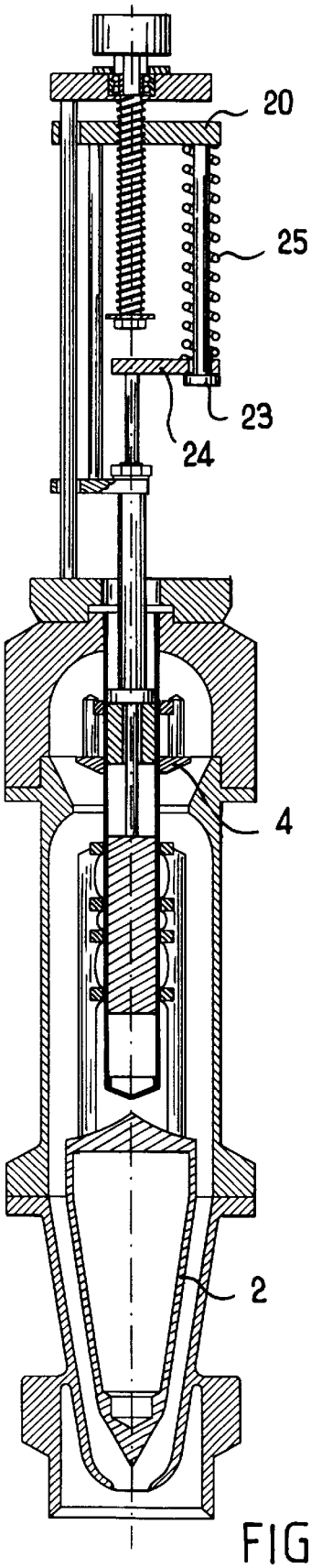
FIG. 3 is a view analogous to the FIG. 1 view, in a position in the middle of the filling cycle.

During this movement, the flow-rate adjustment member 4 and the valve member 2 move simultaneously upwards to a position in which the flow-rate adjustment member 4 is in its position of maximum flow rate, and in which the valve member 2 is opened to the maximum extent, as shown by FIG. 3. The filling spout remains in this position during most of the filling cycle. At the end of filling, the actuating motor 18 is controlled in a direction in which it drives the actuating member 20 downwards. The valve member 2 and the flow-rate adjustment member move simultaneously downwards due to the force exerted by the spring 25 that maintains the control plate 24 in abutment against the end-of-stroke abutment 23. Just before the valve member 2 closes, the flow-rate adjustment member 4 and the valve member 2 are once again in the position shown in FIG. 2. As the actuating member 20 continues to move downwards, the filling spout returns to the position shown in FIG. 1. The filling spout is then ready for a new cycle.

Figure 4:
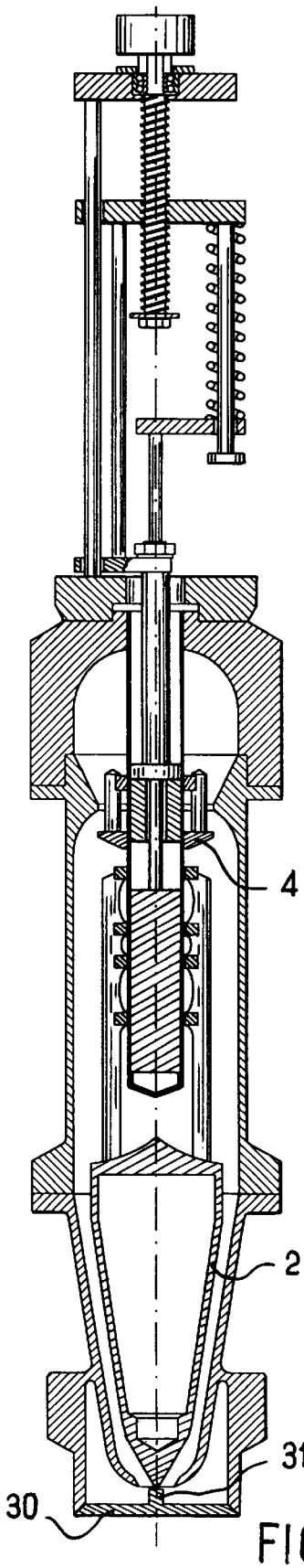
FIG. 4 is a view analogous to the FIG. 1 view, in a cleaning position for cleaning the filling spout.

During washing, the actuating member 20 is put in the high position, a stopper 30 provided with a central projection 31 is put in place in known manner at the bottom of the valve body 1, and then the actuating member 20 is returned to the low position. In this position, shown in FIG. 4, the flow-rate adjustment member is in its position of maximum flow rate, and the valve member 2 is held wide open by the projection 31, thereby enabling the washing substance to flow away.

Figure 5:
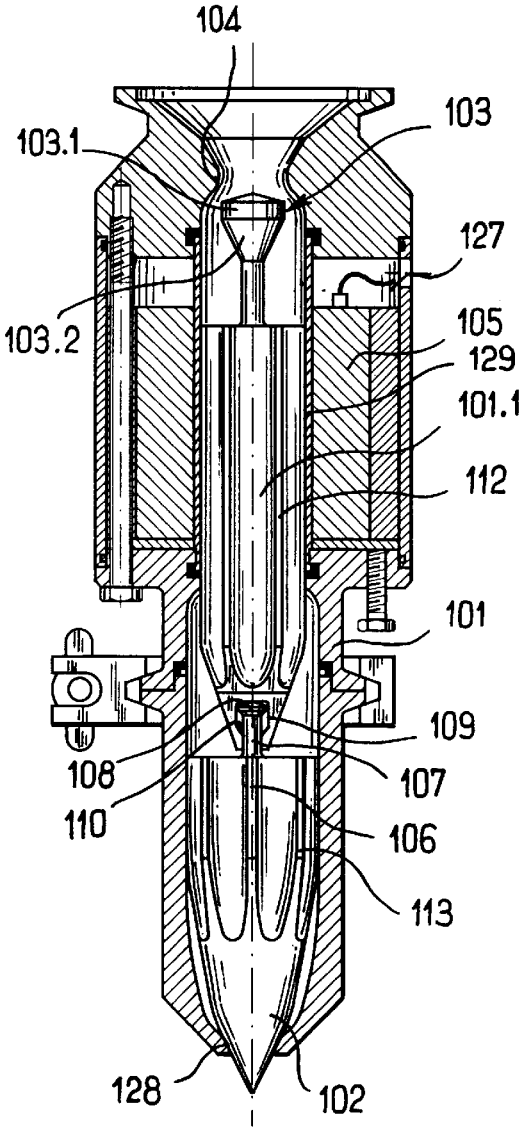
FIG. 5 is a fragmentary diagrammatic longitudinal section view of a second embodiment of a filling spout of the invention in its position at the beginning and at the end of the filling cycle.

As shown in FIG. 5, the second embodiment of the filling spout of the invention comprises a valve body 101 receiving a valve member 102 provided with radial fins 113 over an upstream portion thereof, and a flow-rate adjustment member 103 disposed upstream from the valve member 102. The flow-rate adjustment member 103 is made up of a cylindrical upstream portion 103.1 and of a frustoconical downstream portion 103.2. The flow-rate adjustment member 103 is mounted to slide facing a portion of the valve body 101 that is provided with a constriction 104 of varying section, and it is connected rigidly to a core 111 provided with radial fins 112 and extending axially below the adjustment member 103. The core 111 is slidingly mounted in a tube 129 made of non-magnetic material which is itself tightly mounted to form a portion of the valve body surrounded by an electromagnetic winding 105 secured to the valve body 101. The electromagnetic winding 105 is connected in known manner to electrical power supply control means (not shown) so as to co-operate with the core 101 to form an actuator device for actuating the adjustment member 103. The valve body 101 and the valve member 102 are made of a non-magnetic material such as stainless steel. The adjustment member 103 may be made of a non-magnetic material, but it is preferably made of the same material as the core so as to simplify manufacture.

An empty annular space 127 forming a non-magnetic portion is provided in the valve body 101 and immediately adjacent to a top end of the electromagnetic winding 105.

The valve member 102 has an upstream end 106 from which a stud 107 extends. The stud has a top end provided with a head 108. The head 108 is slidably received in an axial direction in a recess 109 which is provided in a downstream end of the core 101 and whose bottom portion is provided with a shoulder 100 for abutting against the head 108.

The head 108 is of axial size that is smaller than the axial size of the recess so that the recess 109 and the head 108 form a link with axial clearance enabling the adjustment member 103 to move to a limited extent relative to the valve member 102.

More precisely, the axial clearance is determined so that, starting from a position in which the valve member is closed and the adjustment member is in the position of maximum flow rate, reciprocating motion of the core 111 makes it possible to perform the steps mentioned in the preamble of the present description.

In the second embodiment that is shown and in the position shown in FIG. 5, the axial clearance is organized so that, when the valve member is in abutment against its seat 128, the flow-rate adjustment member 103 is positioned below the constriction 104 in the valve body 101 so as to allow maximum flow rate through the constriction 104. The valve member 102 is thus firmly held in the closed position, while the flow-rate adjustment member 103 is in the maximum flow-rate position, thereby making it possible to feed the bottom portion of the valve body 101 without any risk of air bubbles being trapped, even with a substance having high viscosity.

Figure 6:
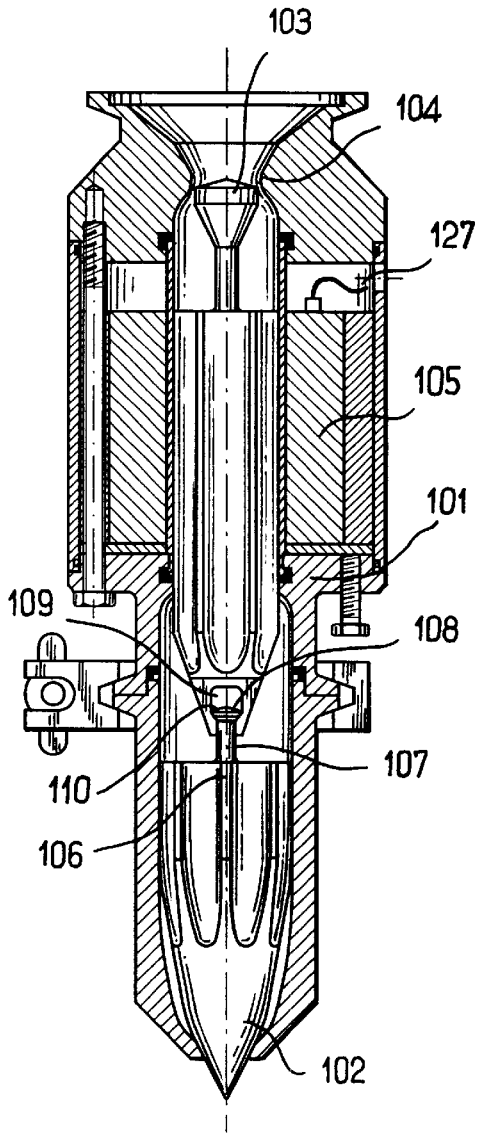
FIGS. 6 and 7 are views analogous to the FIG. 5 view, showing the second embodiment of the filling spout in successive positions immediately after the beginning of a filling cycle.

It is in this position that a filling cycle is started. Starting from this position, the electromagnetic winding is excited to raise the flow-rate adjustment member 103. So long as the shoulder 110 of the recess 109 is not in contact with the head 108 of the stud 107, the valve member 102 remains closed (FIG. 6). As from the instant at which the shoulder 110 of the recess 109 comes into contact with the head 108, the valve member 102 is suspended by the head 108 from the shoulder 110 of the recess 109 of the core 111. The core 111 continuing to move upwards causes the adjustment member 103 and the valve member 102 to be moved simultaneously, thereby causing the valve member 102 to open progressively. The axial clearance is determined so that, at the time at which the shoulder 110 of the recess 109 comes into contact with the head 108, the flow-rate adjustment member 103 is facing the minimum cross-section of the constriction 104. It should be noted that the shoulder 110 coming into contact with the head 108 causes a jolt which makes it possible to lift the valve member 102 away from its seat, which is particularly advantageous after a prolonged stoppage, and when the filling substance is gooey. During normal production, it is possible to limit this jolt or even reduce it to zero by making provision for the magnetic winding 105 always to be fed with a current that is greater than or equal to (depending on the desired position) a minimum value sufficient to raise the core 111 without raising the valve member 102 so as to maintain permanent contact between the shoulder 110 and the head 108.

Figure 7:
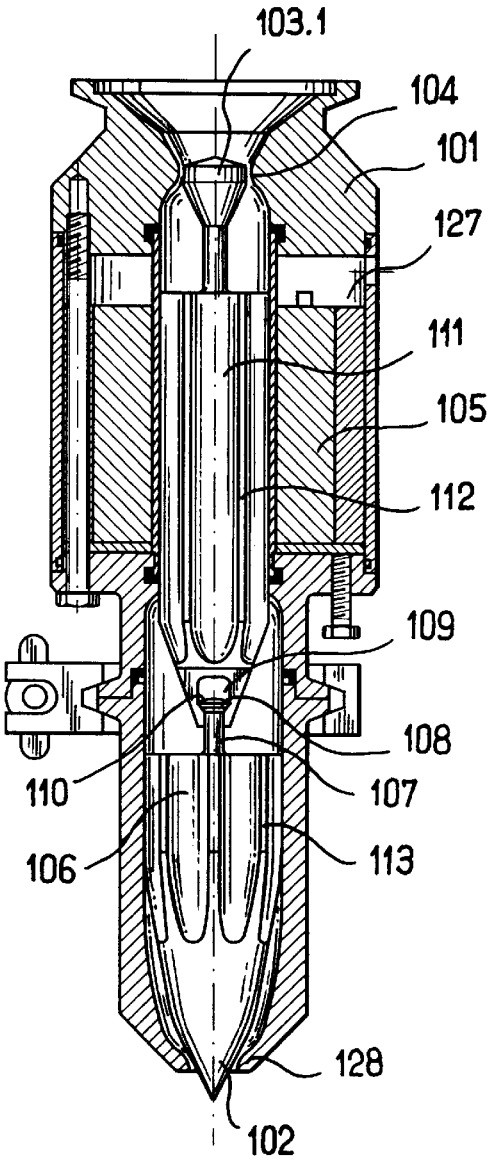

When the valve member 102 is in the position just after the start of opening, as shown in FIG. 7, the cylindrical portion 103.1 of the adjustment member 103 faces the constriction so that the flow rate remains substantially at a minimum. The dynamic pressure of the jet of substance flowing out from the filling spout is thus low, thereby preventing froth from forming at the start of filling. The flow rate remains at its minimum for a time corresponding to the cylindrical portion 103.1 going past the minimum-section portion of the constriction 104. The height of the cylindrical portion 103.1 is determined so that said time makes it possible to insert into the container a quantity of substance that is sufficient to damp the impact of the jet against the top surface of the substance contained in the container. It should be noted that the minimum flow rate may be substantially zero since the flow through the valve member is very low and can be provided by the quantity of liquid contained in the filling spout before the valve member opens. However, it is preferable to maintain at least a minimum flow rate, making it possible to sustain continuous filling from the filling spout.

Figure 8:
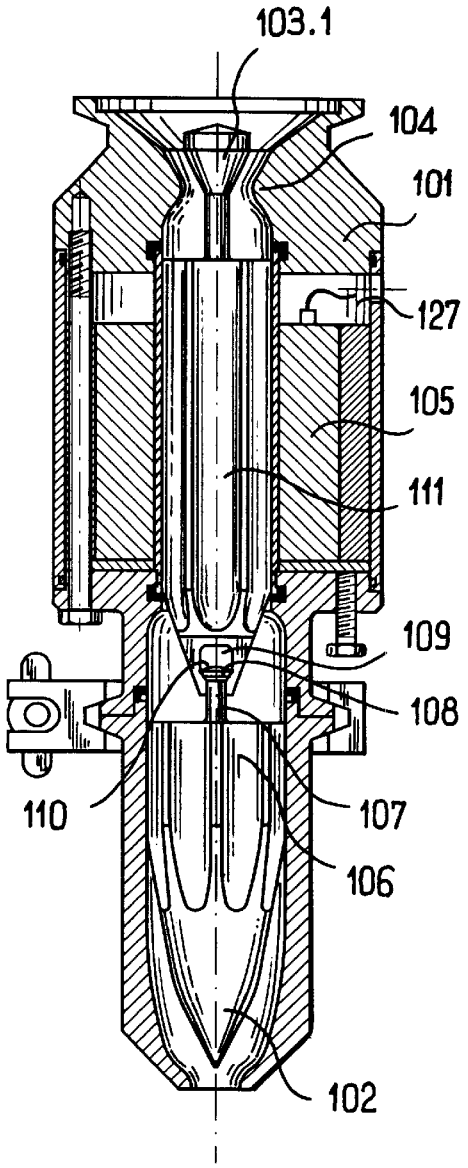
FIG. 8 is a view analogous to the FIG. 5 view, showing the second embodiment of the filling spout in a position in the middle of the filling cycle.

Since the core 11 continues to move upwards, the flow-rate adjustment member 103 and the valve member 102 move simultaneously upwards until the flow-rate adjustment member 103 is in a position of maximum flow rate, and until the valve member 102 is opened to a maximum extent corresponding to the core 111 being in the position of maximum magnetic flux in the winding 105, as shown by FIG. 8. The filling spout remains in this position during most of the filling cycle. At the end of filling, the power supply to the electromagnetic winding 105 is interrupted or brought to a known minimum valve indicated above, which causes the core 111 to be displaced downwards under the effective of gravity and of the dynamic and static forces exerted by the liquid on the core 111. The valve member 102 and the flow-rate adjustment member 103 move simultaneously downwards. Just before the valve member 102 closes, the flow-rate adjustment member 103 and the valve member 102 are once again in the position shown in FIG. 6. With the continued downward movement of the flow-rate adjustment member 103, the filling spout returns to the position shown in FIG. 5, in which position, the end-wall of the recess 109 rests on the head 108 of the valve member 102. The filling spout is then ready for a new cycle.

It should be noted that, throughout flow, the fins 112 of the core 111, and the fins 113 of the valve member 102 not only center the members but also guide the flow, thereby preventing turbulence from forming in the flow, in particular when the filling spout is carried by a rotary carrousel.

It should also be noted that, at the time at which the valve member opens, the force of the jet of substance is low because the flow-rate adjustment member is adjusted substantially to its minimum flow rate, so that the impact against the bottom of the container is itself low, and so that the risk of froth forming is minimized. Similarly, on valve member closure, the reduction in the flow rate caused by the flow-rate adjustment member minimizes the deformation of the jet, and makes it possible to avoid splashing the outside of the container.

The empty space forming a non-magnetic portion 127 immediately adjacent to the top end of the magnetic winding 105 makes it possible to open the magnetic field, thereby increasing the possible stroke of the core 111.

Figure 9:
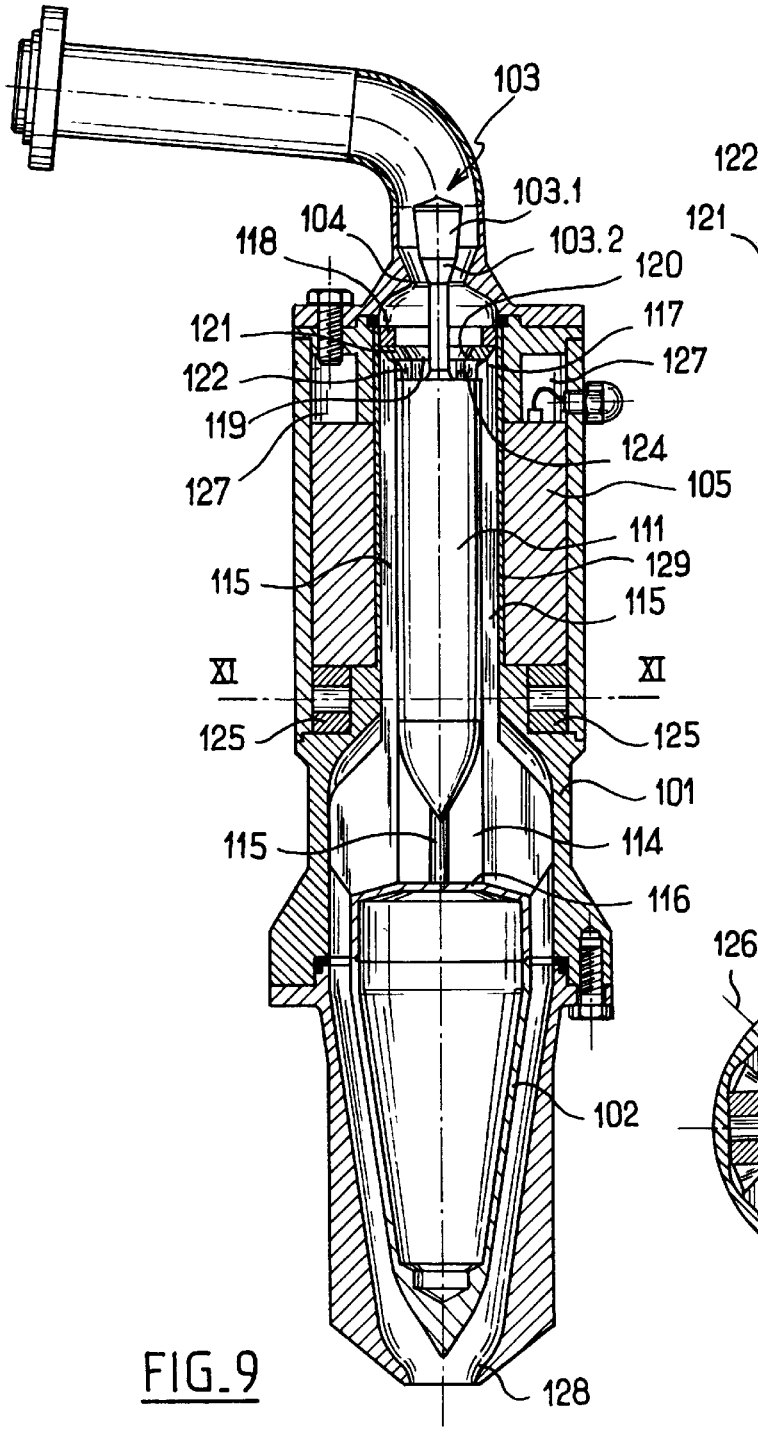
FIG. 9 is a view analogous to the FIG. 5 view, showing a third embodiment of the filling spout in a position in the middle of the filling cycle.
Figure 10:
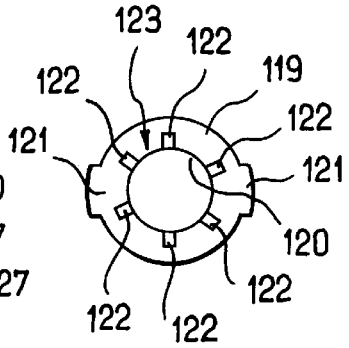
FIG. 10 is a plan view of the underside of an abutment washer of the third embodiment of the filling spout.
Figure 11:
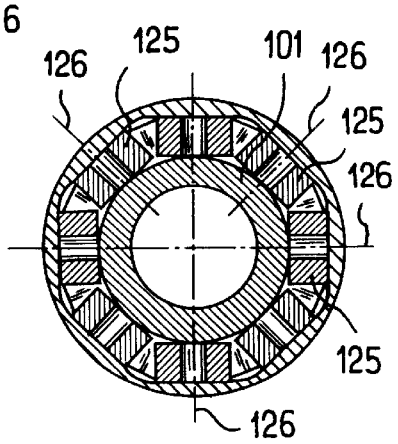
FIG. 11 is a view in cross-section on the line XI—XI of FIG. 9, showing the valve body of the second embodiment of the filling spout.

Elements identical or analogous to above-described elements are given like numerical references in the following description of the third embodiment, given with reference to FIGS. 9 to 11.

As above, the filling spout comprises a valve body 101, a valve member 102, and a flow-rate adjustment member 103 which is made up of a frustoconical upstream portion 103.1 and of a frustoconical downstream portion 103.2 (the frustoconical shape of the downstream portion 103.2 being more pronounced than the frustoconical shape of the upstream portion 103.1), and which is mounted to slide facing a portion of the valve body 101 that is provided with a constriction 104 of varying section.

The adjustment member 103 is rigidly connected to a slide 111 extending axially below the adjustment member 103 in a recess 114 which is associated with the valve member 102, and in which the slide 111 is slidably received.

The recess 114 is formed by radial fins 115 extending axially in the upstream direction from a top end 116 of the valve member 102. The fins 115 have ends 117 opposite from the valve member 102 which are united by a ring 118 forming a retaining abutment for retaining the slide in the recess 114. The ring 118 has an inside diameter larger than the outside diameter of the slide 111.

A washer 119 is mounted to slide in the recess 14 between the ring 118 and the slide 111. The washer 119 is provided with a central bore 120 of diameter smaller than the outside diameter of the slide 111 and the washer has an outside diameter smaller than the inside diameter of the ring 118. The washer 119 has two opposite lugs 121 which project outwardly. Each lug is slidably received between two adjacent fins 115 so as to come into abutment against the ring 118. Spacer fingers 122 project axially from a bottom face 123 of the washer 124 so as to come into abutment against a top face 125 of the slide 111.

The sum of the axial dimensions of the washer 119 (including the fingers 122) and of the slide 111 is less than the axial dimension of the recess 114, so that the recess 114 and the slide 111 form a link with axial clearance making it possible for the adjustment member 103 to be moved to a limited extent relative to the valve member 102 in a manner identical to the manner in which it can move in the second embodiment.

The actuator device for actuating the filling spout includes an electromagnetic winding 105 that is secured to the valve body 101 and that extends around the recess 114. The slide 111 thus forms the core of the electromagnetic actuator device.

The actuator device includes a plurality of permanent magnets 125 that are of annular shape and that are secured to the valve body 101. The permanent magnets 125 are disposed adjacently to the bottom end of the electromagnetic winding 105 in a circular configuration, and they have central axes 126 extending radially relative to the valve body 101.

An annular empty space 127 forming a non-magnetic portion is provided in the valve body 101 immediately adjacent to a top end of the electromagnetic winding 105.

The third embodiment of the filling spout operates analogously to the second embodiment of the filling spout.

The plurality of permanent magnets 125 make it possible to increase the magnetic power generated when the electromagnetic winding 105 is energized.

The configuration of the electromagnetic actuator device makes it possible for a given displacement of the slide to reduce the current fed to the electromagnetic winding, and, for the same voltage, to lift a larger mass.

As above, the fins 115 center the valve member 102 and the slide 111, and guide the flow.

The washer 119 makes it possible to maintain the top surface 124 of the slide 111 spaced apart from the ring 118, in order to leave a passageway for the filling substance, thereby guaranteeing that the flow of filling substance is distributed optimally, and that the flow rates are uniform. By moving upwards during operation of the filling spout, the slide 111 causes the washer 119 to be raised with it, the lugs 121 on the washer then coming into contact with the bottom surface of the ring 118 so as to cause the valve member 102 to be raised if the upward movement of the slide 111 continues.

The configuration described makes it possible to facilitate disassembly of the assembly comprising the valve member 102 and the adjustment member 103. The washer 119 can thus be extracted from the recess 114 by tilting it, and then sliding it via one of its lugs 121 through the ring 118. The slide can then itself be extracted from the recess 114 by causing it to pass through the ring 118.

Naturally, the invention is not limited to the embodiments described, and variant embodiments are possible without going beyond the ambit of the invention as defined by the claims.

In particular, the link between the valve member and the flow-rate adjustment member may be of very different structure, resulting, for example, from inverting the moving parts.

Although, in the first embodiment, the deformable link member is illustrated by a spring disposed around a guide rod, it is possible to replace said spring with an elastomer block disposed between the control member 20 and the valve member control element 24, and fixed to said control member and to said control element.

Similarly, in the first embodiment, although the guide rod 22 is shown separate from the link rod 21, it is possible to mount the control element 24 to slide on said link rod 21, the spring 25 being disposed as above between the actuating member 20 and the valve member control element 24. The end-of-stroke abutment can then be provided either by a collar fixed to the link rod 21 below the valve member control element 24 or by the top end of the control tube 14.

Although the first embodiment is described with reference to a stepper actuating motor, it is also possible to implement the invention by replacing the stepper motor with an actuator or with any other actuating motor. When the substance to be packaged does not need the use of magnetic control, it is also possible to provide a direct mechanical link firstly between the actuating member 20 and the flow-rate adjustment member 4, and secondly between the valve member control element 24 and the valve member 2.

Although the first embodiment of the filling spout is shown with a single deformable link member, it is possible to provide a plurality of elastically-deformable link members distributed uniformly around the axis of the actuator device in order to balance the forces on the actuating member 20.

Although the adjustment member of the second embodiment is shown with a cylindrical portion associated with a conical portion, it is possible to provide a adjustment member that is made up of two frustoconical portions having differing vertex angles, or that is formed of a single frustoconical portion, or else that is a adjustment member in the form of a disk mounted to move in register with a constriction having a corresponding profile.

Although the second and third embodiments are described with reference to magnetic control comprising a central core disposed in a winding, it is possible to use central magnetic control associated with an annular adjustment member. It is also possible to provide a mechanical actuator device such as an actuator or an electric motor connected to the flow-rate adjustment member 103, the recess 109 then being provided at the bottom end of a link rod fixed to the flow-rate adjustment member 103.

Although in these embodiments, the non-magnetic portion is described in the form of an empty space, it may also be implemented in the form of a plate of non-magnetic material. In a variant, a ferromagnetic plate may be fixed to the top end of the electromagnetic winding 105 to close the magnetic field generated by the electromagnetic winding 105.

In a non-disassemblable version of the third embodiment, the slide 111 may come directly into abutment against a shoulder of the recess 114.

Although the permanent magnets are shown to be of annular shape, and organized in a circle, other magnet shapes and configurations are possible, and in particular annular permanent magnets disposed so that their central axes are parallel to the axis of the valve body 101. It is naturally possible to dispose permanent magnets in the vicinity of the bottom end of the electromagnetic winding 5 of the second embodiment.

In general, the magnetic actuator device of the invention is applicable to any type of filling spout.

What is claimed is:

1. A filling spout having an adjustable flow rate and comprising a valve body receiving a valve member extending facing a valve seat, and a flow-rate adjustment member disposed upstream from the valve member and extending in register with a constriction in the valve body, the valve member and the flow-rate adjustment member being connected to a single actuator device via means allowing limited axial movement by enabling the adjustment member and the valve member to move axially relative to each other to a limited extent.

2. A filling spout according to claim 1, wherein the means allowing limited axial movement are suitable for enabling the flow-rate adjustment member to be put in position of maximum flow rate or of minimum flow rate, while the valve member is in a closed position.

3. A filling spout according to claim 1, wherein the valve member is connected to a valve member control device, and the flow-rate adjustment member is associated with a adjustment control device connected to the actuator device, the actuator device including an actuating member to which the adjustment control device is connected via a rigid link, and to which the valve member control device is connected via a deformable link member comprising a spring mounted on a guide rod associated with the actuating member, the spring having one end that bears against a valve member control element mounted to slide on the guide rod, said guide rod being equipped with an end-of-stroke abutment.

4. A filling spout according to claim 1, wherein the actuator device comprises a stepper motor associated with an actuating screw co-operating with the actuating member.

5. A filling spout according to claim 1, wherein the means allowing limited axial movement comprise a stud extending axially from an upstream end of the valve member, and having a top end provided with a head that is slidably received in a recess rigidly associated with a adjustment member, the recess being provided with a shoulder forming a retaining abutment for retaining the head in the recess.

6. A filling spout according to claim 5, wherein the actuator device comprises an electromagnetic winding secured to the valve body extending around a core that is rigidly connected to the adjustment member.

7. A filling spout according to claim 6, wherein the core is disposed below the adjustment member, and wherein the recess is formed in a bottom downstream end of the core.

8. A filling spout according to claim 1, wherein the adjustment member is secured to a slide slidably received in a recess formed by radial fins extending axially in the upstream direction from a top end of the valve member, that end of each of the fins which is opposite from the valve member being associated with an element forming a retaining abutment for retaining the slide in the recess.

9. A filling spout according to claim 8, wherein the retaining abutment is formed by a ring uniting said ends of the fins, and having an inside diameter greater than the outside diameter of the slide, and wherein a washer having an inside diameter smaller than the outside diameter of the slide and an outside diameter smaller than the inside diameter of the ring is mounted to slide in the recess between the ring and the slide, the washer having two opposite radially-projecting lugs that are slidably received between adjacent fins so as to come into abutment against the ring, and spacer fingers axially projecting to come into abutment against a top face of the slide.

10. A filling spout according to claim 8, wherein the actuator device comprises an electromagnetic winding secured to the valve body and extending around the recess, the slide forming a core.

11. A filling spout according to claim 10, wherein at least one permanent magnet is mounted adjacent to a bottom end of the electromagnetic winding.

12. A filling spout according to claim 11, wherein a plurality of annular permanent magnets are disposed in a circular configuration and which have central axes extending radially relative to the valve body.

13. A filling spout according to claim 6 or claim 10, wherein the actuator device includes a non-magnetic portion immediately adjacent to a top end of the electromagnetic winding.

* * * * *